US006484955B2

(12) United States Patent
Hsu

(10) Patent No.: US 6,484,955 B2
(45) Date of Patent: Nov. 26, 2002

(54) SHREDDING MACHINE

(76) Inventor: Liang-Ching Hsu, 4F, No 607-1, Hsin Shu Rd., Shin Chuang Taipei Hsien (TW)

( * ) Notice: Subject to any disclaimer, the term of this patent is extended or adjusted under 35 U.S.C. 154(b) by 0 days.

(21) Appl. No.: 09/912,466

(22) Filed: Jul. 24, 2001

(65) Prior Publication Data

US 2002/0139882 A1 Oct. 3, 2002

Related U.S. Application Data

(63) Continuation-in-part of application No. 09/819,526, filed on Mar. 27, 2001.

(51) Int. Cl.[7] ..... B02C 18/06; B02C 18/18

(52) U.S. Cl. ..... 241/236; 241/285.1

(58) Field of Search ..... 241/100, 166, 241/167, 236, 294, 295, 285.1

(56) References Cited

U.S. PATENT DOCUMENTS 5,328,107 A * 7/1994 Tsai ..... 241/236

6,241,170 B1 * 6/2001 St. Clair ..... 241/166

FOREIGN PATENT DOCUMENTS

| | | | |
|---|---|---|---|
| DE | 4240953 | * | 6/1994 |
| GB | 2059804 A | * | 4/1981 |
| GB | 2061128 | * | 5/1981 |

* cited by examiner

*Primary Examiner*—John M. Husar
(74) *Attorney, Agent, or Firm*—Pro-Techtor International Services

(57) ABSTRACT

A shredding machine includes cutter holders and washers mounted in a base frame to hold two sets of circular cutters on two parallel shafts, a motor adapted to rotate the shafts through a transmission gear set, and baffle means installed in the base frame to support the cutter holders and to protect the circular cutters from deformation,_the cutter holders each having an invertedly disposed T-shaped holder body, at least one through hole for the passing of the revolving shafts, and pulleys disposed at different elevations and supported on the revolving shafts at top and bottom sides.

5 Claims, 5 Drawing Sheets

SHREDDING MACHINE

CROSS-REFERENCE TO RELATED APPLICATION

The present invention is a continuation-in-part of application Ser. No. 09819,526 now pending Filing Date Mar. 27, 2001.

BACKGROUND OF THE INVENTION

A regular shredding machine generally comprises a base frame, two revolving shafts connected in parallel to the base frame, cutter holder blocks and washers respectively mounted on the revolving shafts, and cutters respectively mounted in between each two adjacent washers and alternatively arranged on the revolving shafts. When inserting paper into the shredder during rotation of the revolving shafts, the cutters cut inserted paper into narrow strips. Due to deformation problem, cutter pitch changes quickly with the use of the shredder. U.S. patent application Ser. No. 09819,526 now pending, teaches the use of a baffle of <-shaped cross section to protect cutters against deformation. This design is functional, however it is still not perfect.

SUMMARY OF THE INVENTION

According to one embodiment the present invention, the cutter holders each have a flat holder body and at least one through hole through the flat holder body for the passing of the revolving shafts, and baffles are installed in the base frame to support the holder body of each of the cutter holders in position. According to another embodiment of the present invention, two baffles of zigzag cross section are provided to support the cutter holders in position. According to still another alternate form of the present invention, two symmetrical pairs of flat baffles are mounted in the base frame at different elevations and respectively stopped at top and bottom sides of the cutter holders to support the cutter holders in position. According to still another alternate form of the present invention, pulleys are mounted in the cutter holders at different elevations and respectively supported on the revolving shafts at top and bottom sides.

DETAILED DESCRIPTION OF THE PREFERRED EMBODIMENT

Figure 1:
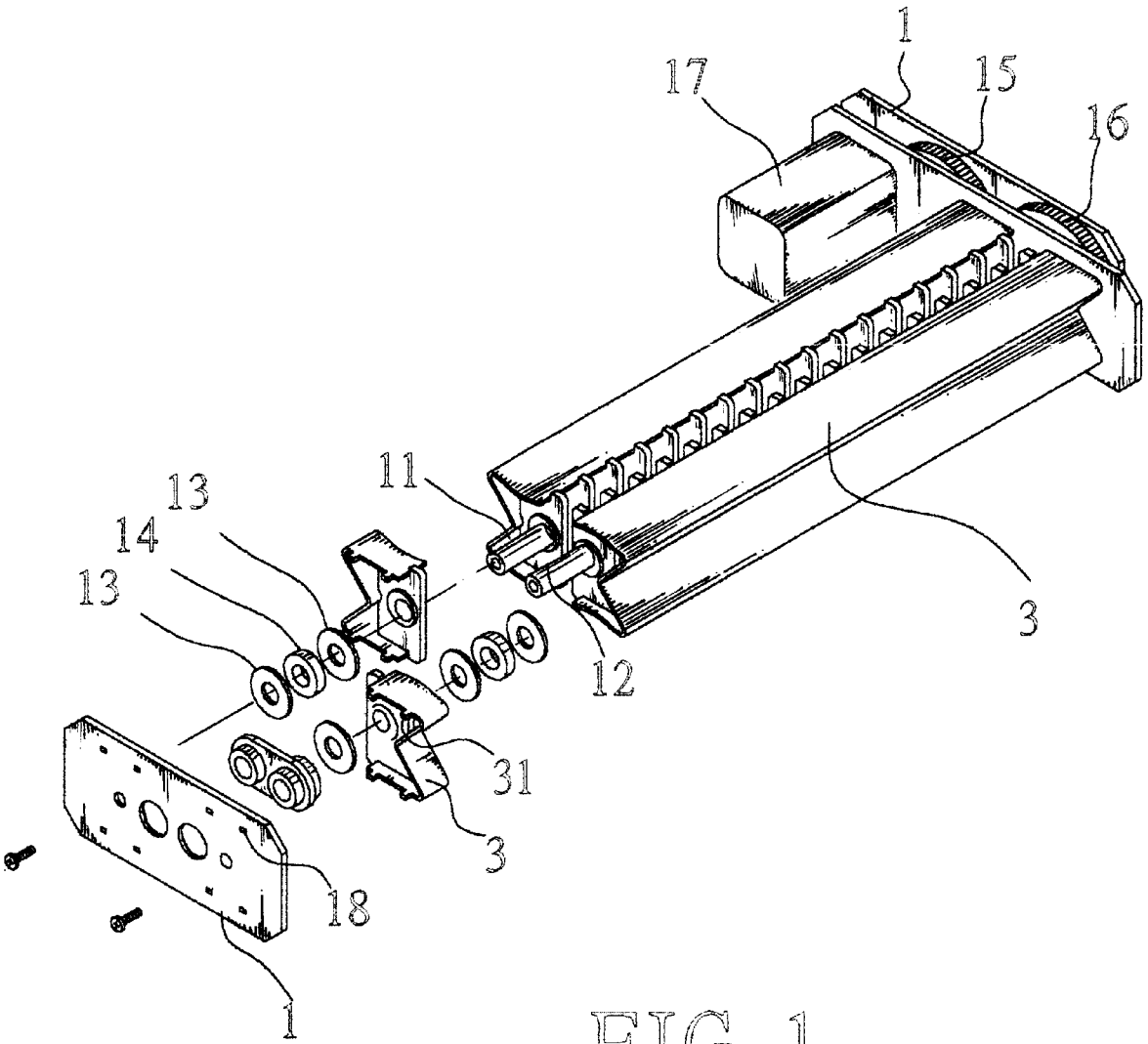
FIG. 1 is an exploded view of a shredding machine according to the present invention.

Referring to FIG. 1, two revolving shafts 11;12 are inserted through cutter holders 2 and pivoted to two opposite end walls of a hollow base frame 1. Washers 13 are respectively in the hollow base frame 1 around the revolving shafts 11;12 between the cutter holders 2 to secure circular cutters 14 to the revolving shafts 11;12. Two gear wheels 15;16 are installed in the base frame 1 and driven by a motor 17 at the base frame 1 to rotate the revolving shafts 11;12. Upon rotary motion of the revolving shafts 11;12, the respective circular cutters 14 are rotated with the revolving shafts 11;12 to cut inserted paper into narrow strips. The cutter holders 2 each comprise a holder body 21 and a through hole 22 through the holder body 21 for the passing of the respective revolving shaft 11 or 12. Two baffles 3 of zigzag cross section are respectively fastened to the cutter holders 2 at an outer side to protect the cutters 14 against deformation. The baffles 3 have respective end ribs 31 respectively engaged into respective locating holes 18 in the base frame 1.

Figure 2:
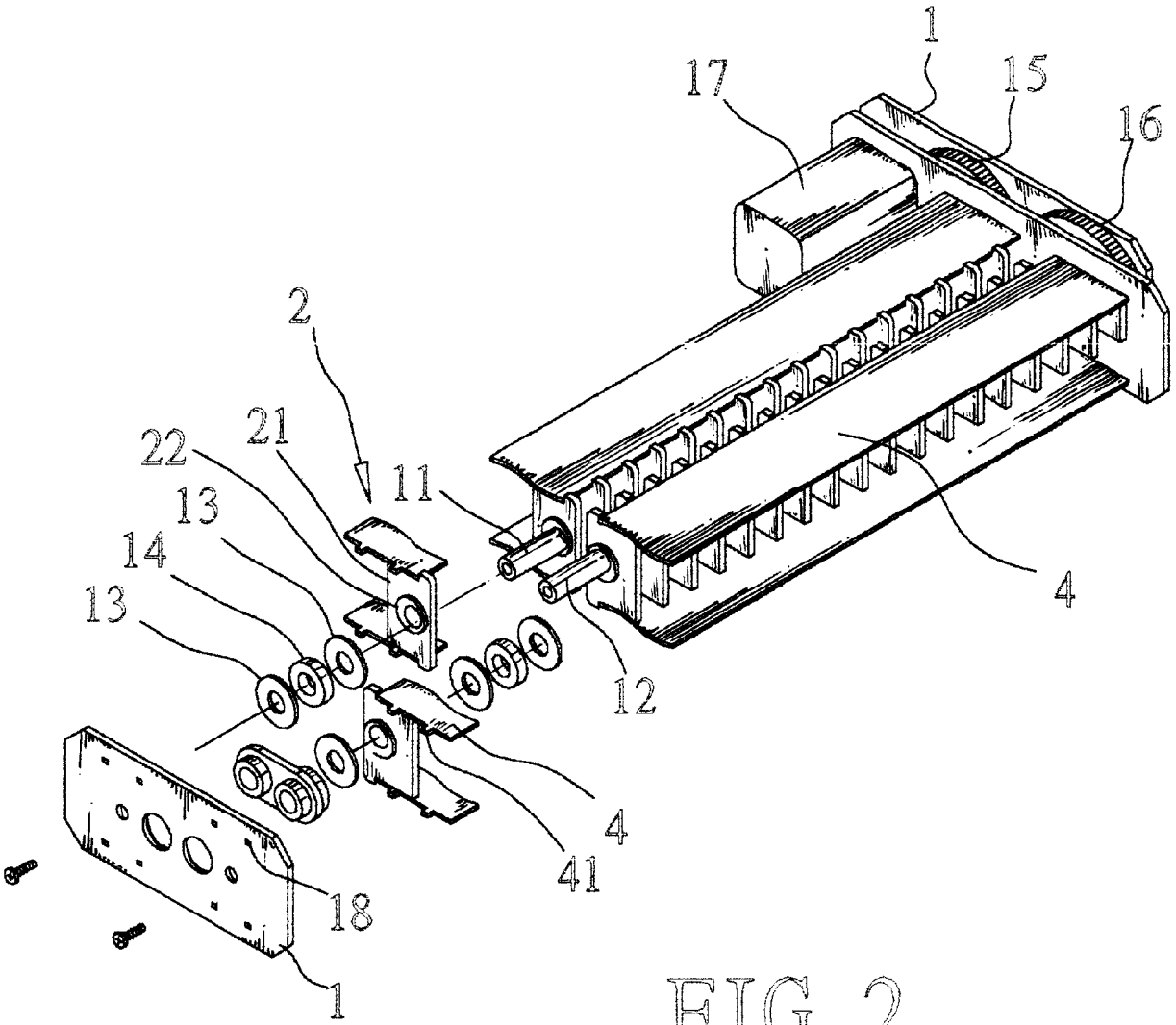
FIG. 2 is an exploded view of an alternate form of the shredding machine according to the present invention.

Referring to FIG. 2, the cutter holders 2 each comprise an invertedly disposed T-shaped holder body 23 and a through hole 24 through the holder body 23 for the passing of the respective revolving shaft 11 or 12. Two symmetrical pairs of baffles 4 are respectively bilaterally fastened to top and bottom sides of the cutter holders 2 to protect the circular cutters 14 against deformation. The baffles 4 have respective end ribs 41 respectively engaged into respective locating holes 18 in the base frame 1.

Figure 3:
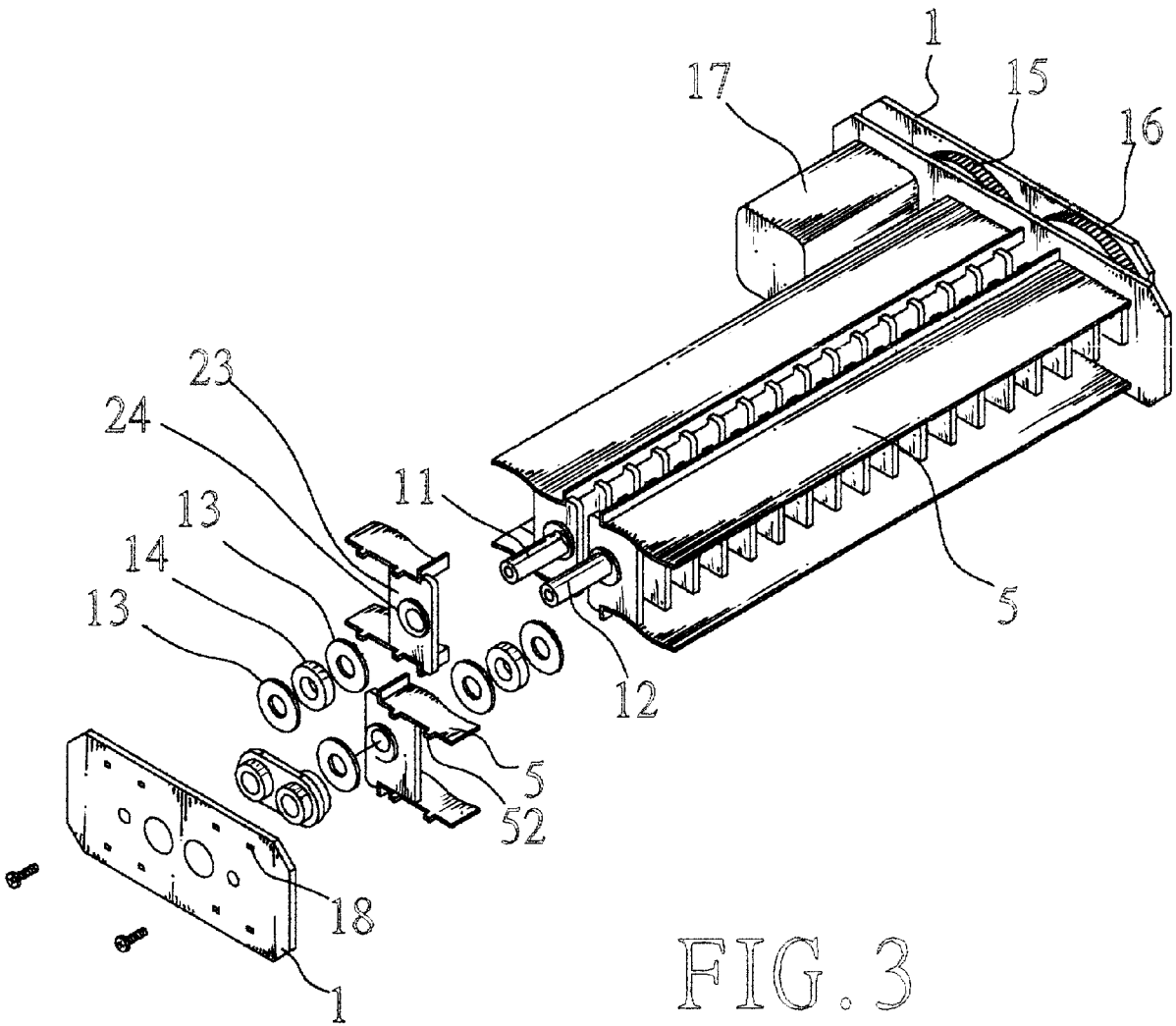
FIG. 3 is an exploded view of another alternate form of the present invention.

Referring to FIG. 3, the cutter holders 2 each comprise an invertedly disposed T-shaped holder body 23 and a through hole 24 through the holder body 23 for the passing of the respective revolving shaft 11 or 12. Two symmetrical pairs of angled baffles 5 of L-shaped cross section are respectively bilaterally fastened to top and bottom sides of the cutter holders 2 to protect the circular cutters 14 against deformation. The angled baffles 5 each have a vertical section 51 stopped at the protruded front side of the T-shaped holder body 23 of each of respective cutter holders 2, and respective end ribs 51 respectively engaged into respective locating holes 18 in the base frame 1.

Figure 4:
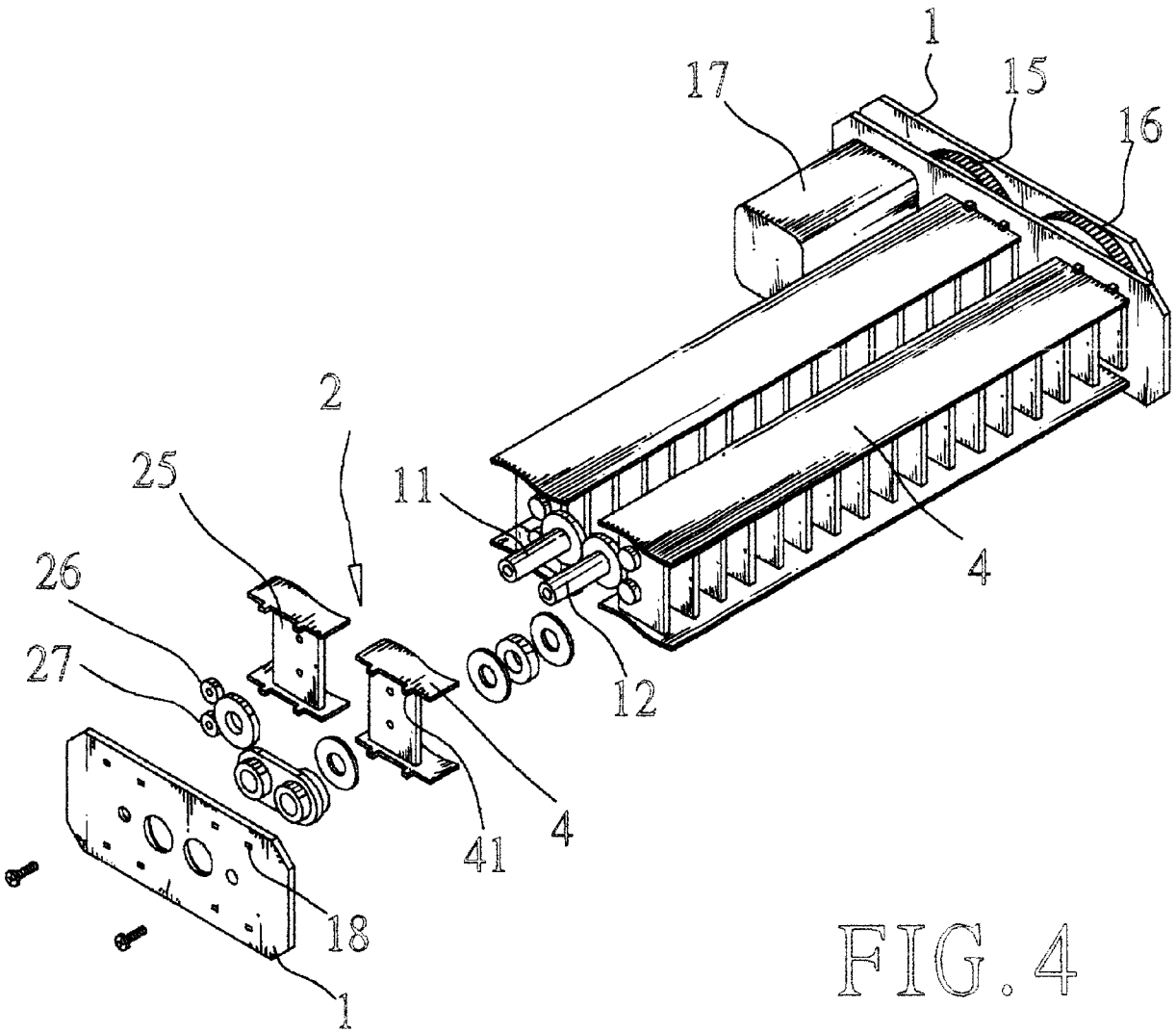
FIG. 4 is an exploded view of still another alternate form of the present invention.

Referring to FIG. 4, the pulleys 26;27 are respectively mounted in the holder body 25 of each of the cutter holders 2 and supported on the revolving shafts 11;12 at different elevations to protect the circular cutters against deformation.

Figure 5:
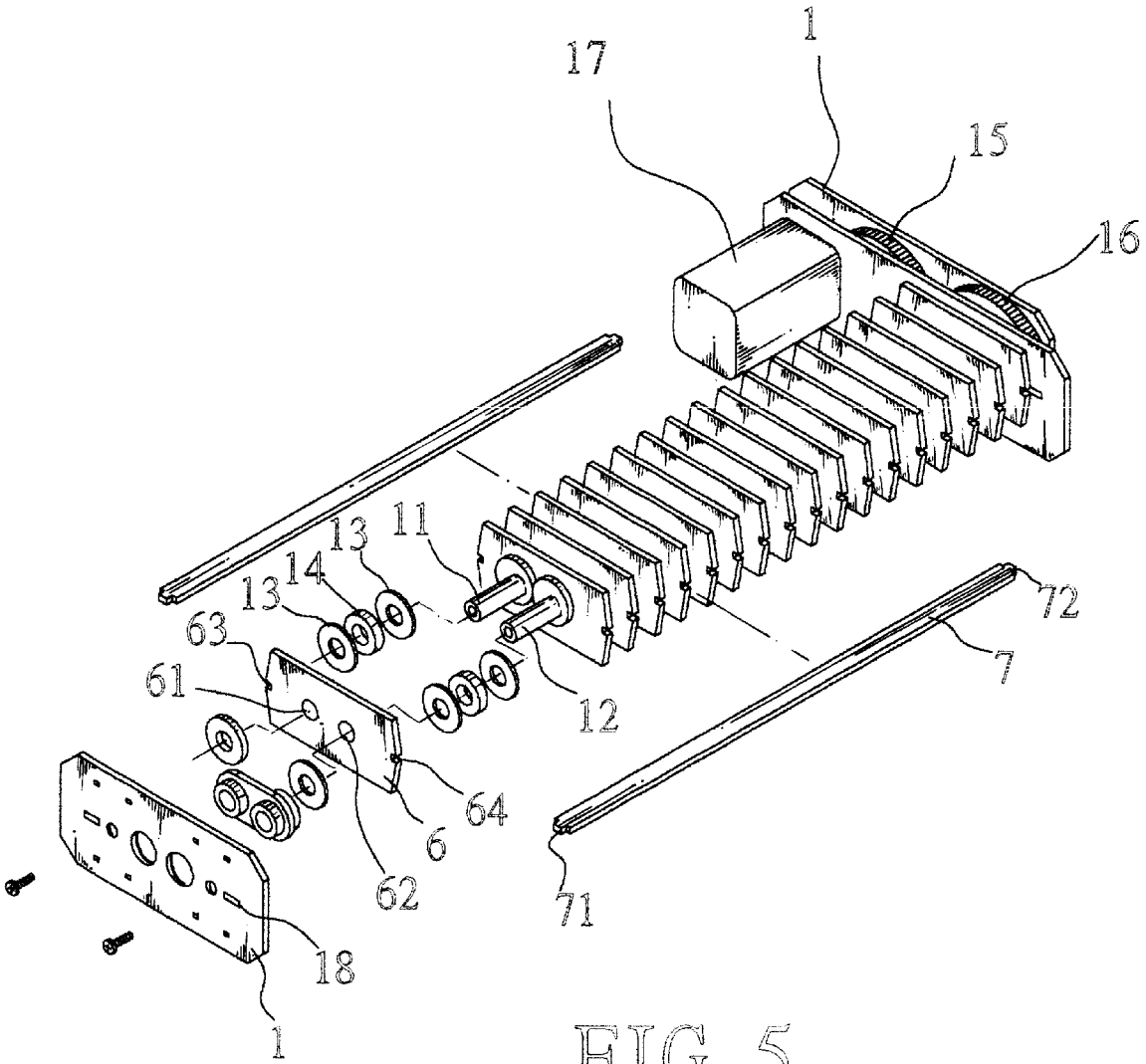
FIG. 5 is an exploded view of still another alternate form of the present invention.

Referring to FIG. 5, cutter holders 6 are mounted on the revolving shafts 11;12 and arranged in parallel to hold respective washers 13 and circular cutters 14 on the revolving shafts 11;12. The cutter holders 6 each have two through holes 61;62 for the passing of the revolving shafts 11;12, and two end notches 63;64 for the positioning of two locating rods 7. The locating rods 7 each have two end ribs 71 respectively engaged into respective locating holes 18 in the base frame 1.

A prototype of shredding machine has been constructed with the features of FIGS. 1~5. The shredding machine functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A shredding machine comprising a hollow base frame having two opposite end walls, a plurality of cutter holders, two revolving shafts inserted through said cutter holders and pivoted to the two opposite end walls of said hollow base frame, circular cutters respectively mounted on said revolving shafts for synchronous rotation with said revolving shafts, washers respectively disposed around said revolving shafts in between said cutter holders to secure said circular cutters to said revolving shafts, two gear wheels installed in said hollow base frame, and a motor installed in said hollow base frame and controlled to rotate said gear wheels to further rotate said revolving shafts, wherein said cutter holders each have an invertedly disposed T-shaped holder body and at least one through hole for the passing of said revolving shafts, and baffle means is installed in said hollow base frame to support said cutter holders and to protect said circular cutters from deformation, said baffle having end ribs respectively fastened to the opposite end walls of said hollow frame.

2. The shredding machine of claim 1 wherein said baffle means comprises two baffle plates of zigzag cross section respectively fastened to said cutter holders at two sides between the opposite end walls of said hollow base frame.

3. The shredding machine of claim 1 wherein said baffle means comprises two symmetrical pairs of flat baffles respectively connected between the opposite end walls of said hollow base frame and respectively stopped at top and bottom sides of said cutter holders.

4. The shredding machine of claim 1 wherein said baffle means comprises two angled baffle plates of L-shaped cross section connected between the opposite end walls of said hollow base frame, said angled baffle plates each having a vertical section respectively stopped at a protruding front side of said cutter holders.

5. The shredding machine of claim 1 wherein said cutter holders each comprise a holder body and a plurality of pulleys mounted in said holder body and supported on said revolving shafts at top and bottom sides.

* * * * *